US008525054B2

(12) United States Patent
Pai et al.

(10) Patent No.: US 8,525,054 B2
(45) Date of Patent: Sep. 3, 2013

(54) DISCHARGE MECHANISM FOR CIRCUIT BREAKER

(75) Inventors: Arvind Pai, Karnataka State (IN); Kapil Vinodrao Bavikar, Beed (IN); Sudhakar Sapuram, Secunderabad (IN); Glen Charles Sisson, Wolcott, CT (US)

(73) Assignee: General Electric Schenectady, New York, NY (US)

( * ) Notice: Subject to any disclaimer, the term of this patent is extended or adjusted under 35 U.S.C. 154(b) by 423 days.

(21) Appl. No.: 12/971,668

(22) Filed: Dec. 17, 2010

(65) Prior Publication Data

US 2012/0152703 A1 Jun. 21, 2012

(51) Int. Cl.

| | |
|---|---|
| ***H01H 9/20*** | (2006.01) |
| ***H01H 9/24*** | (2006.01) |
| ***H01H 33/42*** | (2006.01) |

(52) U.S. Cl.

USPC ..... 200/50.24; 200/50.21

(58) Field of Classification Search

USPC ..... 200/50.21–50.27

See application file for complete search history.

(56) References Cited

U.S. PATENT DOCUMENTS

| | | | | |
|---|---|---|---|---|
| 4,101,744 | A | 7/1978 | Wilson | |
| 4,146,764 | A | 3/1979 | Wilson | |
| 4,146,765 | A | 3/1979 | Wilson | |
| 4,209,676 | A | 6/1980 | Clausing | |
| 5,334,808 | A | 8/1994 | Bur et al. | |
| 5,477,016 | A | 12/1995 | Baginski et al. | |
| 6,951,990 | B1 | 10/2005 | Miller | |
| 7,964,809 | B2 * | 6/2011 | Sapuram et al. | 200/50.21 |
| 2009/0255788 | A1 * | 10/2009 | Narayanasamy et al. | 200/50.21 |
| 2010/0025204 | A1 | 2/2010 | Sapuram et al. | |

OTHER PUBLICATIONS

Search Report and Written Opinion from corresponding EP Application No. 11191851.2 Mar. 28, 2012.

Product Catalogue: "Masterpact NW DC Circuit Breakers" 0613CT0501R1/07; Merlin Gerin Square D Telemecanique; Nov. 2007 (64 pages); Schneider Electric, Cedar Rapids IA USA.

Product Catalogue "LV circuit breakers and switch-disconnectors direct current 16 to 4000A Compact NS Masterpact NW"; Merlin Gerin; 2005 (14 pages); Schneider Electric, Cedar Rapids IA USA.

* cited by examiner

*Primary Examiner* — Renee Luebke
*Assistant Examiner* — Lheiren Mae Caroc
(74) *Attorney, Agent, or Firm* — Cantor Colburn LLP

(57) ABSTRACT

A circuit breaker and mechanism are provided for opening circuit breaker contact arms when the circuit breaker is moved between an installed and a withdrawn position in a drawout installation. The circuit breaker has a cross shaft coupled to a first linkage that rotates in response to the circuit breaker being moved. A second linkage translates in response to said first linkage rotating. A cam surface is operably coupled between the cross shaft and the first linkage. An opening latch shaft is coupled between the second linkage and a contact arm assembly such that the opening latch shaft moves the contact arm assembly from a closed position to an open position in response to the translation of the second linkage.

17 Claims, 6 Drawing Sheets

DISCHARGE MECHANISM FOR CIRCUIT BREAKER

BACKGROUND OF THE INVENTION

The subject matter disclosed herein relates to a mechanism for a circuit breaker. In particular, the subject matter disclosed herein relates to a mechanism coupled to the circuit breaker that opens a contact arm structure and discharges the stored energy the mechanism springs prior to the circuit breaker being installed or removed from service.

Air circuit breakers are commonly used in electrical distribution systems. A typical air circuit breaker comprises an assembly of components for connecting an electrical power source to a consumer of electrical power called a load. The electric circuit the circuit breaker is connected to is referred to herein as the protected electric circuit. The components are referred to as a main contact assembly. In this assembly, a main contact is typically either opened, interrupting a path for power to travel from the source to the load, or closed, providing a path for power to travel from the source to the load. In a particular type of circuit breaker, referred to as an air circuit breaker, the force necessary to open or close the main contact assembly is provided by an arrangement of compression springs. When the compression springs discharge, they exert a force that provides the energy needed to open or close the main contacts. Compression springs that provide a force to close the main contacts are often called closing springs. Compression springs that provide a force to open the main contacts are often referred to as contact springs.

The air circuit breakers may be installed in several different configurations. The simplest method is typically referred to as a "fixed breaker" where the installer mounts the air circuit breaker and utilizes hardware, such as bolts for example, to couple the air circuit breaker to the source and load electrical conduits. In this instance, when maintenance or repair is required, the hardware coupling the breaker must be removed before the maintenance or repairs can be performed.

Alternatively, the air circuit breaker may be mounted within a mechanism referred to as a drawout. A drawout is a device well known in the art that holds and carries the air circuit breaker into and out of contact with electrical connections for the source and load. To remove the air circuit breaker from service, the drawout automatically disconnects the circuit breaker from the electrical circuit and moves it into a position for servicing.

In the drawout installation, it is desirable to disconnect the circuit breaker from the protected electrical circuit and to discharge the energy in the compression springs prior to initiating the service work. Issues sometimes arise when retrofitting an older drawout unit with a newer model circuit breaker since interlocks mounted in the drawout unit to discharge the compression springs may not be compatible with the new circuit breaker.

While existing circuit breakers are suitable for their intended purposes, there still remains a need for improvements particularly regarding the operation of the circuit breaker and the discharging of the circuit breaker compression springs to allow the servicing of the circuit breaker in a variety of applications.

BRIEF DESCRIPTION OF THE INVENTION

According to one aspect of the invention, a circuit breaker is provided. The circuit breaker includes a base with a cross shaft operably coupled thereto. The cross shaft being rotatable between a first position and a second position. A first linkage is coupled to the base and arranged transverse to the cross shaft, the first linkage being rotatable between a third position and a fourth position. A second linkage is operably coupled to the first linkage, the second linkage translating between a fifth position and a sixth position in response to the first linkage rotating between the third position and the fourth position. A cam surface is operably coupled between the cross shaft and the first linkage. An opening latch shaft is coupled between said second linkage and a contact arm assembly, wherein the opening latch shaft moves the contact arm assembly from a closed position to an open position in response to the second linkage translating between the fifth position and the sixth position.

According to another aspect of the invention, a circuit breaker is provided having a housing. A base is coupled to the housing. A contact structure is movable between a closed position and an open position and is disposed within the housing. An opening latch shaft is operably coupled to the contact structure. A mechanism is provided that includes a cross shaft operably coupled to the base, the cross shaft rotating between a first position and a second position in response to movement of the circuit breaker. A first linkage is rotationally coupled to the base and arranged transverse to the cross shaft, the first linkage movable between a third position and a fourth position. A cam surface is disposed between the cross shaft and the first linkage, the cam surface moving between a fifth position and a sixth position when the cross shaft rotates between the first position and the second position. A second linkage is coupled between the opening latch shaft and the first linkage, wherein the second linkage translates between a seventh position and an eighth position in response to the first linkage moving between the third position and the fourth position. Wherein the contact structure moves from the closed position to the open position in response to the second linkage translating between the seventh position and the eighth position.

According to yet another aspect of the invention, a method of operating a circuit breaker is provided. The method includes rotating a cross shaft coupled to the circuit breaker. A cam surface is moved from a first position to a second position in response to rotation of the cross shaft. A first linkage is rotated from a third position to a fourth position with the cam surface. A second linkage is translated from a fifth position to a sixth position with the first linkage. A set of contacts is opened with the second linkage when the first linkage is in the fourth position. Wherein the cross shaft rotates in response to a movement of the circuit breaker between and installed and a withdrawn position.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
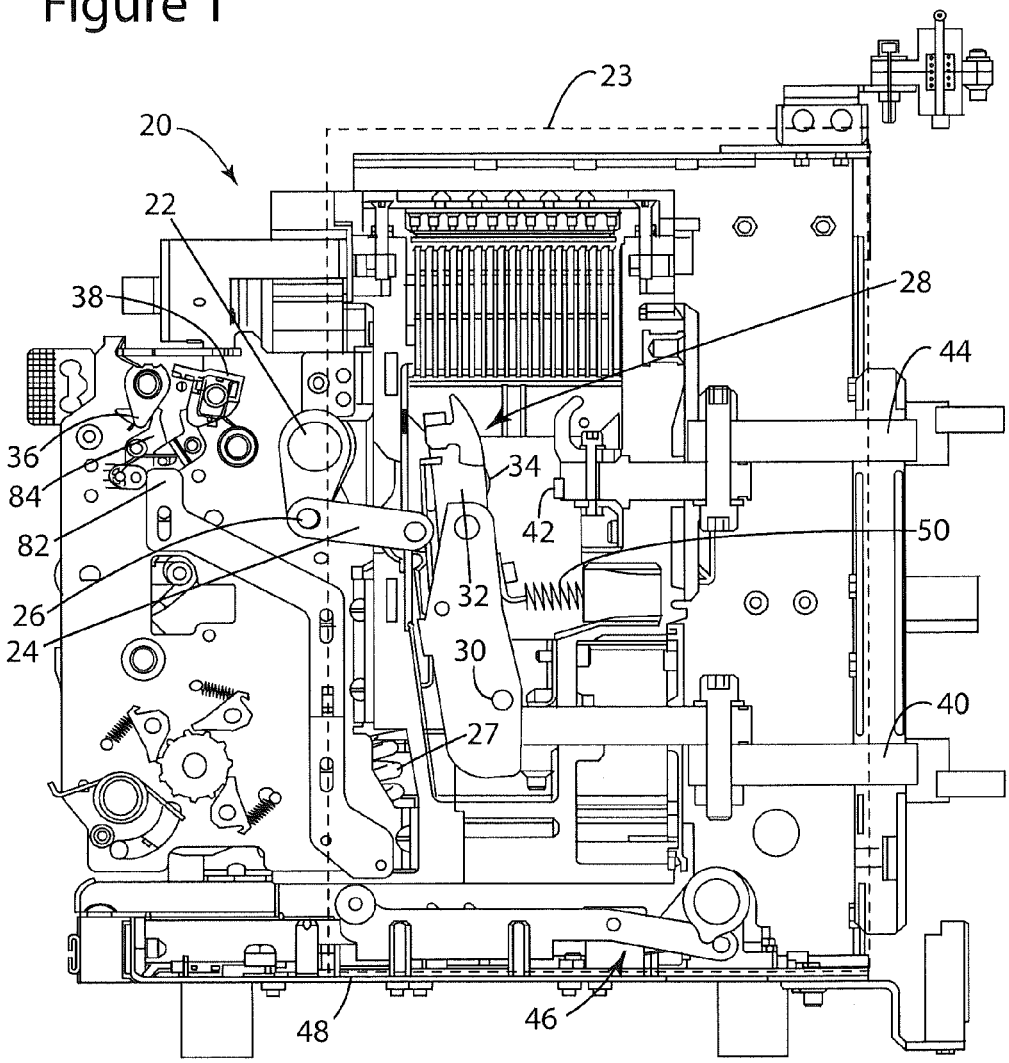
FIG. 1 is a side plan view of a circuit breaker in accordance with an embodiment of the invention.

FIG. 1 illustrates a circuit breaker 20 in the open position. The circuit breaker 20 includes a main mechanism (not shown) arranged within a housing 23. The circuit breaker 20 further includes a racking cassette base 48 disposed on one end of the housing 23. The main mechanism is coupled to a lay shaft assembly 22 that rotates in response to the main mechanism being moved between an on and off position. The lay shaft assembly is coupled to a contact arm coupler 24 through a pin 26. The contact arm coupler 24 as illustrated in FIG. 1 is in a open position and will transfer energy from the main mechanism compression springs (closing springs) 27 that is necessary to close a contact arm assembly 28. The contact arm assembly 28 is mounted in the circuit breaker 20 to pivot about a pin 30 to move between a closed and open position.

It should be appreciated that the contact arm assembly 28 is illustrated in the exemplary embodiment as a single component. However, the contact arm 32 may be comprised of multiple contact arms each coupled to the contact arm coupler 24. Further, the exemplary embodiment illustrates the circuit breaker 20 has a single contact arm or what is commonly referred to as a "pole." Each pole of a circuit breaker carries electrical current for a single electrical phase. In a "multi-pole" circuit breaker the circuit breaker will have several poles, typically three or four, each carrying a different phase of electricity through the circuit breaker 20. Each of the poles is individually connected to the lay shaft assembly 22 through a separate contact arm coupler 24.

The contact arm assembly 28 includes an arm 32 having a movable contact 34 and an arcing contact mounted to one end. A flexible, electrically conductive strap, made from braided copper cable for example, is attached to the opposite end of the arm. The strap electrically couples the contact arm 32 to a conductor 40 that allows electrical current to flow through the circuit breaker 20. The electrical current flows through the contact arm assembly 32 and exits via movable contact 34 and into the protected electric circuit. The current then passes through stationary contact 42 and into conductor 44 where it is transmitted to the protected electric circuit and load.

During normal operation of the circuit breaker 20, the operator may desire to remove electrical power from a circuit. To accomplish this, the main mechanism is activated, by a handle for example, causing the lay shaft assembly 22 to rotate to an open position as illustrated in FIG. 1. The rotational movement of the lay shaft assembly 22 is translated into motion of the contact arm coupler 24 causing the contact arm assembly 28 to rotate about pivot 30. This rotation by the contact arm assembly 28 results in the movable contact 34 separating from the stationary contact 42 and the halting of electrical current flow through the protected electrical circuit. To re-initiate flow of electrical power to the protected electrical circuit, the operator reverses the main mechanism, by moving a handle for example, causing the lay shaft assembly 22 to rotate back to a closed position.

In typical air circuit breakers, the main mechanism will have a closing latch shaft assembly 36 that is used to hold the closing latch linkage (not shown) and a tripping or opening shaft assembly 38 that holds an opening latch linkage (not shown). The rotation of the closing latch shaft assembly 36 will cause the release of the closing latch linkage further causing to release the energy stored in the closing springs 27. This energy will be utilized to close the contact system against the contact springs 50 during the normal closing operation. During the normal closing operation the opening shaft assembly 38 will hold the opening latch linkages. Similarly under normal conditions, the rotation of opening shaft assembly in the anticlockwise direction will cause the opening latch to be unlatched and linkages will collapse allowing the contact springs 50 to open the circuit breaker contacts.

The circuit breaker 20 may be mounted in several different configurations. The two most common are a "fixed" breaker installation and a drawout installation. In the fixed breaker installation, conductors 40, 44 are mechanically fastened to the protected electrical circuit. In a drawout installation, the circuit breaker 20 is installed on a drawout mechanism. The drawout mechanism includes further assemblies that are well known in the art for moving the circuit breaker 20 into and out of connection with the protected electrical circuits. Typically, the drawout mechanism will include mechanical linkages that move the circuit breaker 20 when activated by service or installation personnel.

It is desirable to have the circuit breaker main mechanism springs 27 in the discharged position when maintenance and service operations are being performed. It is further desirable to have the circuit breaker 20 automatically discharge the main mechanism springs 27 during removal or insertion of the circuit breaker 20. The exemplary embodiment illustrates with two methods by which the main mechanism springs 27 can be discharged. One is a manual mode and other is an automatic mode. The manual mode is used mostly in "fixed" breaker installations. The automatic mode is applicable to a drawout installation. exemplary spring discharge mechanism 46 that includes such features is illustrated in FIGS. 1-4.

In the exemplary embodiment, the spring discharge mechanism 46 is mounted on one end of the circuit breaker 20 to the racking cassette base 48. As will be discussed in more detail herein, advantages are gained by mounting the spring discharge mechanism to the circuit breaker 20, rather than to a drawout mechanism. By mounting the discharge mechanism to the circuit breaker 20, incompatibilities between the circuit breaker and the drawout unit may be avoided. Thus, by mounting the spring discharge mechanism 46 to the circuit breaker 20, the spring discharge mechanism 46 may operate in a variety of styles or types of drawout mechanism arrangements, which provides cost and manufacturing advantages.

The spring discharge mechanism 46 includes a cross shaft 52 that rotates in the direction indicated by arrow 54 in response to the circuit breaker 20 being moved into or withdrawn from a drawout installation. In the exemplary embodiment, the cross shaft 52 is movable between a first position (FIG. 2) and a second position (FIG. 3) in response to the movement of the circuit breaker 20. A cam member 56 is disposed on one end of the cross shaft 52. The cam member 56 is coupled to the cross shaft 52 such that the cam member 56 rotates in response to the rotation of the cross shaft 52. A cam surface 58 projects from one side of the cam member 56. It should be appreciated that the cam member 56 and the cam surface 58 move between a first position and a second position in response to the movement of the circuit breaker 20. In another embodiment, the cam surface 58 is integrated into the cross shaft 52.

A pivot linkage 60 is mounted to the racking cassette base 48 by a bracket 62 and a pivot pin 64. In the exemplary embodiment, the pivot linkage 60 is arranged transverse to the cross shaft 52. The pivot linkage 60 is arranged to rotate about the pivot pin 64 are indicated by the arrow 70. The pivot linkage 60 has a first arm 66 that extends on one side of the pivot pin 64. In one embodiment, the first arm 66 is disposed at an angle relative to the plane of the racking cassette base 48. On an end distal from the pivot pin 64, a roller pin 68 is coupled to the first arm 66. The pivot linkage 60 also includes a second arm 72 that extends opposite the first arm 66. In one embodiment, a plurality of standoffs 74 are arranged on opposite sides of the second arm 72. The standoffs 74 are spaced apart to define a gap slightly larger than the width of the pivot linkage 60. The standoffs 74 provide a means for maintaining the pivot linkage 60 in a desired alignment and may prevent damage or displacement of the pivot linkage during shipping, installation and operation.

On an end of the second arm 72 distal from the pivot pin 64, an activator roller 76 is coupled to the second arm 72. The activator roller 76 is arranged adjacent a discharge lever 78. In the exemplary embodiment, the pivot linkage 60 is arranged such that the center of gravity of the pivot linkage 60 is disposed on the second arm 72 such that the roller pin 68 is biased against the cam surface 58. This provides advantages in reliability since the springs or other biasing members are not utilized to maintain the roller pin 68 in contact with the cam surface 58.

In the exemplary embodiment, the activator roller 76 is disposed with a gap between the activator roller 76 and a first end 80 of the discharge lever 78 when the spring discharge mechanism 46 is in the first position. The activator roller 76 contacts the discharge lever 78 as the spring discharge mechanism moves to the second position. The discharge lever 78 is coupled to the circuit breaker 20 to translate in the direction indicated by arrow 86 response to the rotational movement of the pivot linkage 60. The discharge lever 78 includes a second end 82 that is disposed adjacent a trip latch activator lever 84. The trip latch activator lever 84 is coupled to the opening shaft assembly 38 to cause the opening of the contact arm assembly 28 as discussed above.

Figure 2:
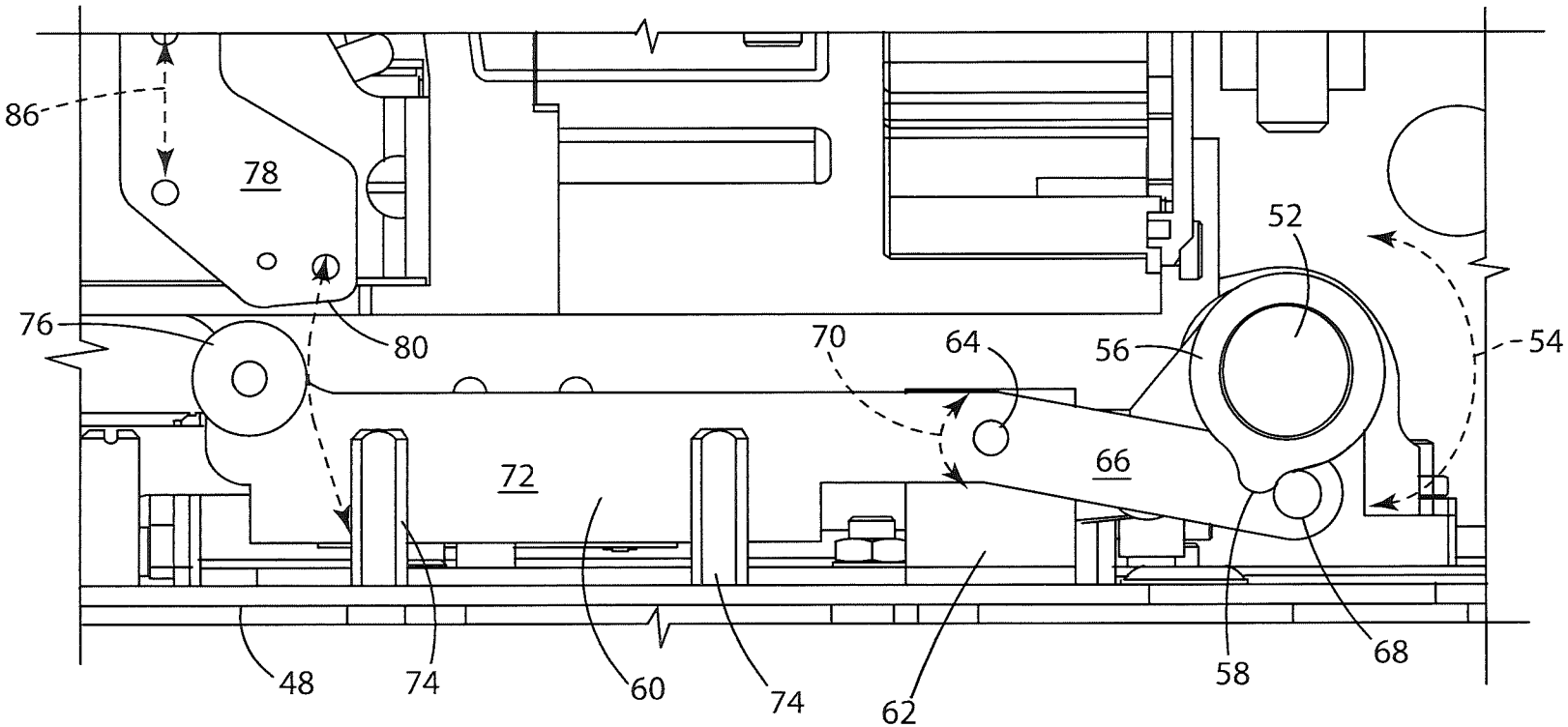
FIG. 2 is a side plan view of a discharge mechanism for the circuit breaker of FIG. 1 in a first position.
Figure 3:
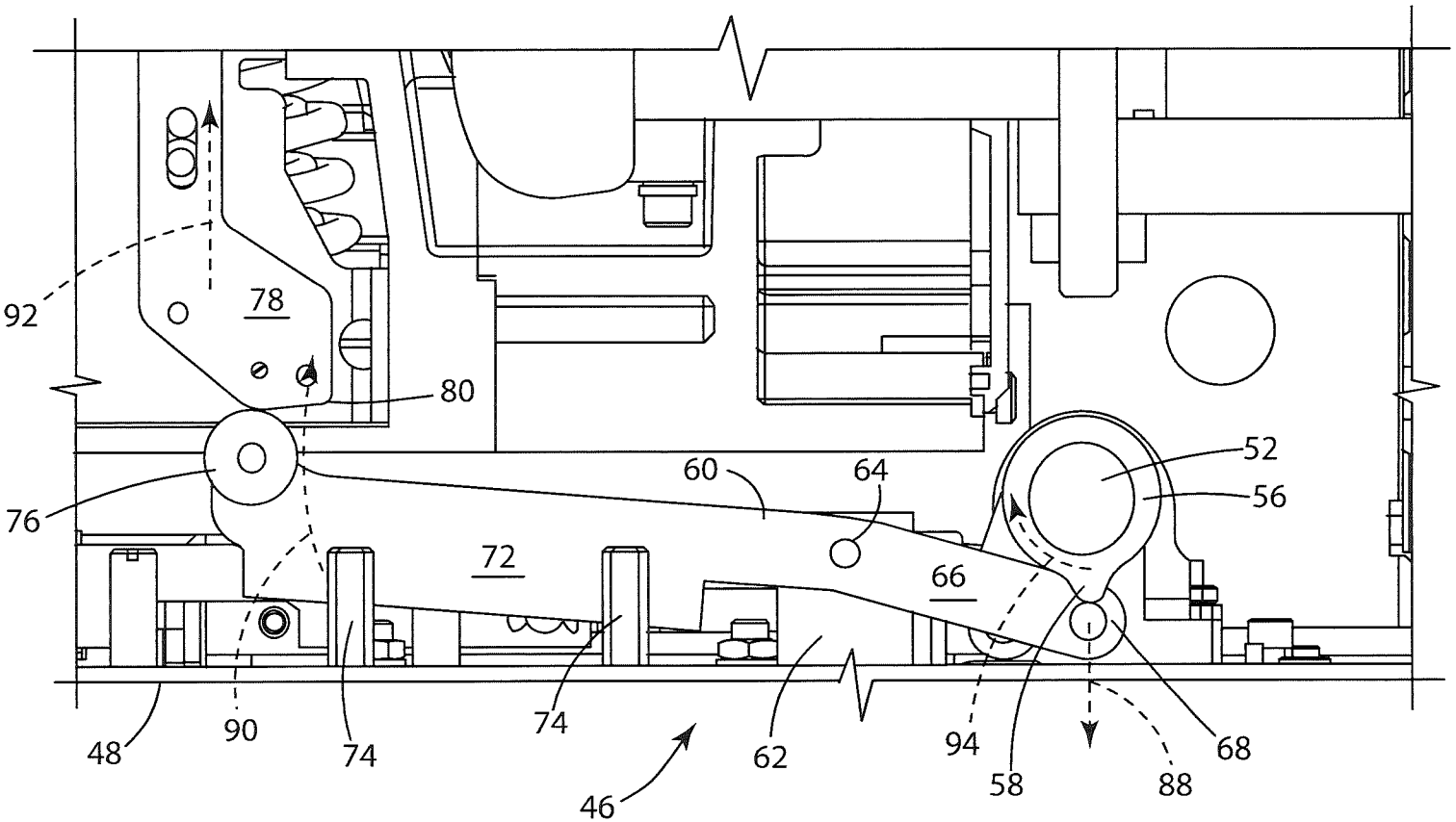
FIG. 3 is a side plan view of the discharge mechanism of FIG. 2 in a second position.
Figure 4:
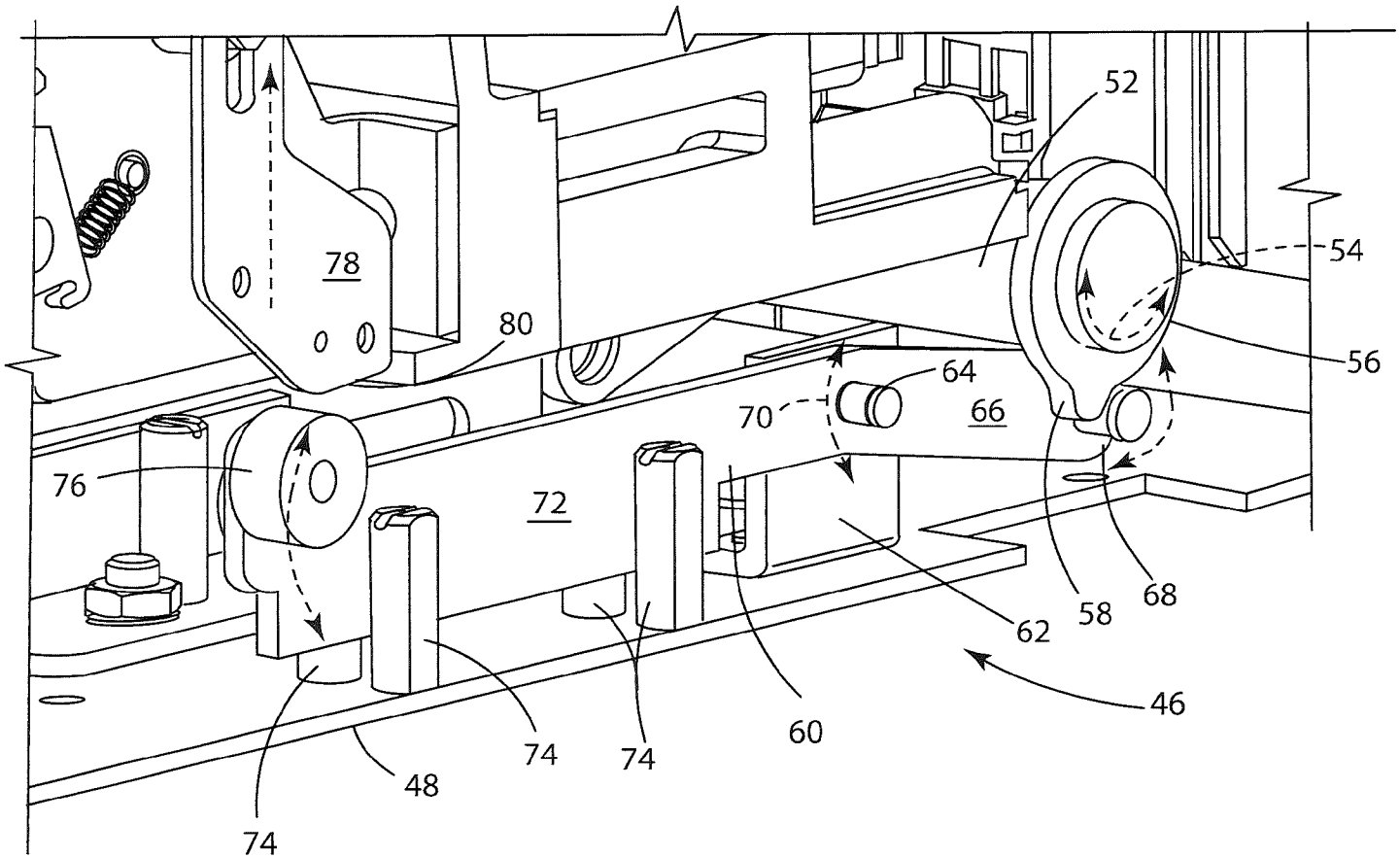
FIG. 4 is a perspective view of the discharge mechanism of FIG. 2.

The spring discharge mechanism 46 is arranged in the first position shown in FIG. 1-2 when the circuit breaker 20 is not installed (or in the fully racked out position) and when the circuit breaker 20 is fully installed (e.g. connected to the conductors 40, 44). As discussed above, it is desirable to have the contact arm assembly 28 in the open position when the circuit breaker 20 is being installed or removed from the drawout installation. During installation or withdrawal of the circuit breaker 20, the cross shaft 52 is configured to rotate from the first position to the second position. As the cross shaft 52 rotates, the cam member 56 and the cam surface 58 also rotate in the direction indicted by arrow 88. Since the roller pin 68 is biased against the cam surface 58, the rotation of the cam member 56 results in the rotation of the pivot linkage 60 as the roller pin 68 engages the cam surface 58.

As the pivot linkages 60 rotates, the activator roller 76 moves in the direction indicated by arrow 90 into contact with the first end 80 of discharge lever 78. As the pivot linkage 60 continues to rotate, the discharge lever 78 translates in the direction of the trip latch activator lever 84, as indicated by arrow 92, causing the trip latch activator to rotate the opening shaft assembly 38. The rotation of the opening shaft assembly 38 results in the opening of the contact arm assembly 28. As the circuit breaker 20 continues to be installed or withdrawn, the cross shaft 52 reverses direction and rotates back to the first position as indicated by arrow 94.

Figure 5:
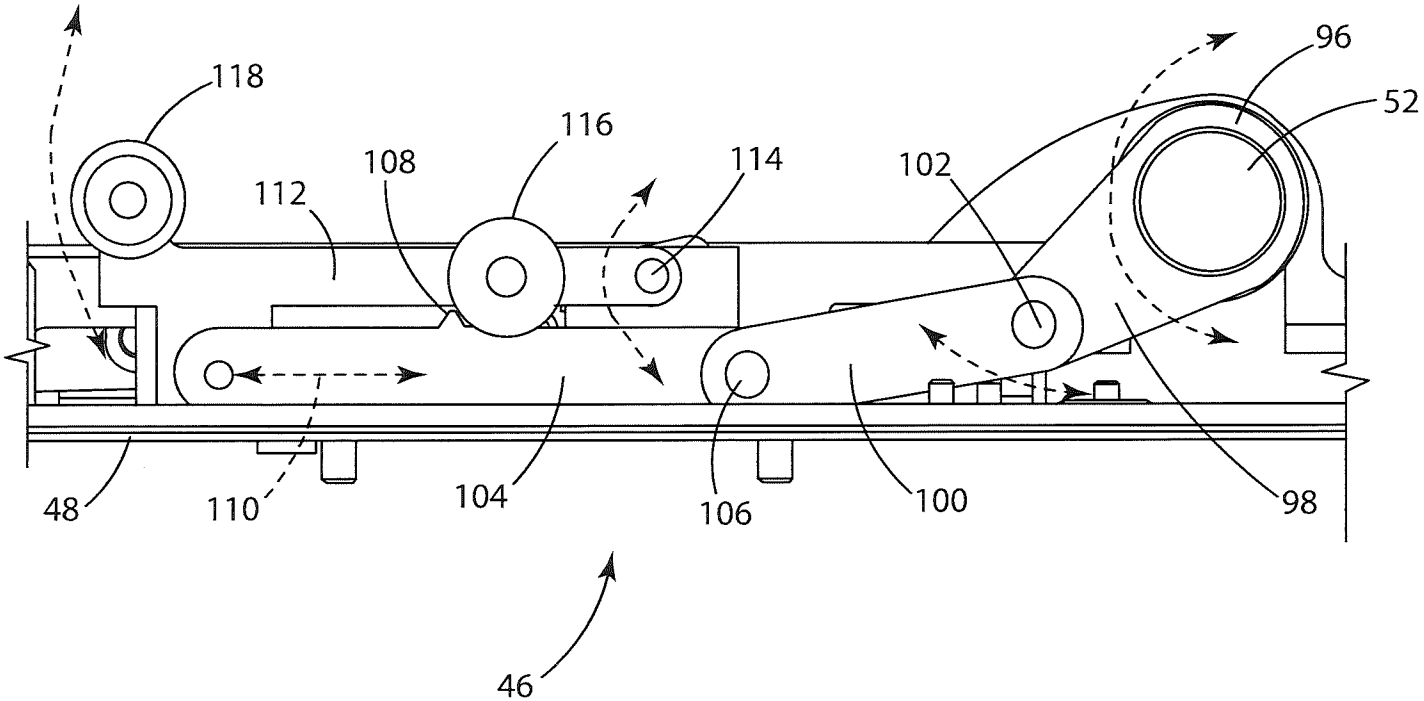
FIG. 5 is a side plan view of a discharge mechanism for the circuit breaker of FIG. 1 in accordance with another embodiment of the invention.
Figure 6:
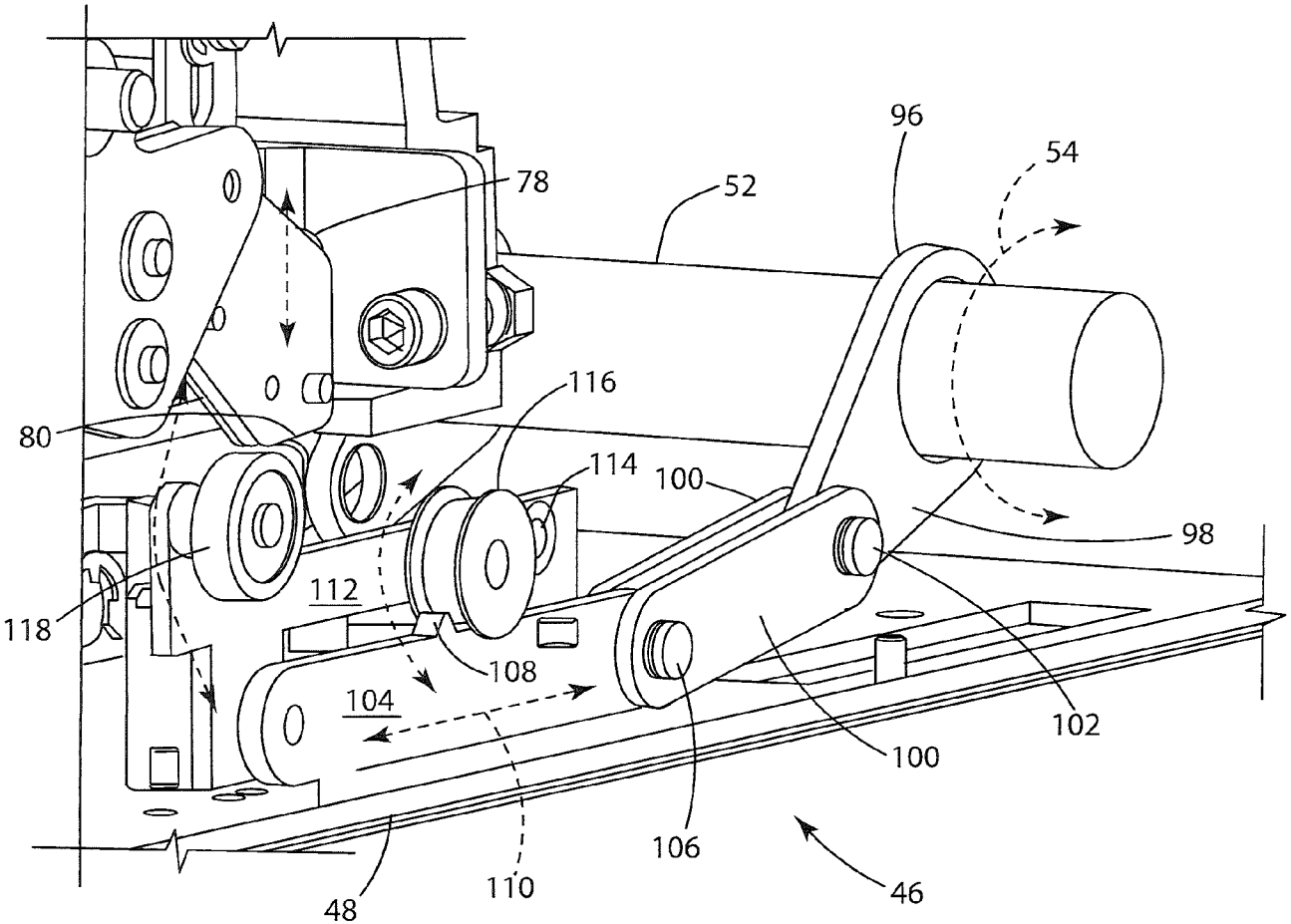
FIG. 6 is a perspective view of the discharge mechanism of FIG. 5.

Referring now to FIGS. 5-6, another embodiment of the spring discharge mechanism 46 is shown. In this embodiment, the cross shaft 52 is configured to rotate in response to the installation or withdrawal of the circuit breaker 20 from a drawout installation. A crank member 96 is coupled to rotate with the cross shaft 52. The crank member 96 has a projection 98 on one side. On an end of the projection 98 that is distal from the cross shaft 52, the crank member 96 couples to a coupler linkage 100. In one embodiment, the spring discharge mechanism includes two coupler linkages 100 arranged on either side of the crank member 96. The coupler linkage 100 is connected to the crank member 96 by a pin 102. This connection allows the coupler linkage to simultaneously rotate and translate in response to the rotation of the cross shaft 52.

On an opposite end of the coupler linkage 100 from the pin 102, the coupler linkage 100 is coupled to a slider linkage 104 by a pin 106. In one embodiment, one side of the slider linkage 104 is in contact with the racking cassette base 48 and transverse to the cross shaft 52. The slider linkage further includes a cam surface 108 on a side opposite the racking cassette base 48. It should be appreciated that the slider linkage 104 translates along the surface of the racking cassette base 48 in response to the rotation of the cross shaft 52 as indicated by the arrow 110.

The spring discharge mechanism 46 further includes a pivot linkage 112. The pivot linkage 112 rotates about a pin 114. Adjacent the pin 114, a roller 116 is coupled to the pivot linkage 112 adjacent the cam surface 108. In one embodiment, the center of gravity of the pivot linkage 112 is arranged to bias the roller 116 towards the slider linkage 104. The pivot linkage 112 further includes an activator roller 118 disposed at an end opposite pin 114. The activator roller 118 is disposed adjacent to the first end 80 of discharge lever 78.

When the circuit breaker 20 installed or withdrawn from a drawout installation, the cross shaft 52 rotates. The rotation of the cross shaft 52 results in the translation of the slider linkage 104 towards the cross shaft 52 via coupler linkage 100. As the slider linkage 104 translates, the roller 116 engages the cam surface 108 causing the pivot linkage 112 to rotate. As the pivot linkage 112 rotates, the activator roller 118 contacts the first end 80 of the discharge lever 78. The translation of the discharge lever 78 in response to the activator roller 118 activates the opening shaft assembly 38 as described herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A circuit breaker comprising:

a base;

a cross shaft operably coupled to said base, said cross shaft rotatable between a first position and a second position;

a first linkage coupled to said base and arranged transverse to said cross shaft, said first linkage rotatable between a third position and a fourth position;

a second linkage operably coupled to said first linkage, said second linkage translating between a fifth position and a sixth position in response to said first linkage rotating between said third position and said fourth position;

a cam surface operably coupled between said cross shaft and said first linkage;

an opening latch shaft coupled between said second linkage and a contact arm assembly, wherein said opening latch shaft moves said contact arm assembly from a closed position to an open position in response to said second linkage translating between said fifth position and said sixth position;

a first roller coupled to said first linkage adjacent said cam surface; and a second roller coupled to said first linkage adjacent said second linkage.

2. The circuit breaker of claim 1 wherein said first linkage includes a pivot.

3. The circuit breaker of claim 2 wherein said pivot is disposed between said first roller and said second roller.

4. The circuit breaker of claim 2 wherein said pivot is disposed adjacent said first roller opposite said second roller.

5. The circuit breaker of claim 4 further comprising:

a third linkage coupled to said cross shaft; and a fourth linkage coupled between said third linkage and said first linkage, said fourth linkage translating between a seventh position and an eighth position, wherein said cam surface is disposed on said fourth linkage.

6. A circuit breaker comprising:

a housing;

a base coupled to said housing;

a contact structure movable between a closed position and an open position and is disposed within said housing;

an opening latch shaft operably coupled to said contact structure;

a mechanism including:

a cross shaft operably coupled to said base, said cross shaft rotating between a first position and a second position in response to movement of said circuit breaker;

a first linkage rotationally coupled to said base and arranged transverse to said cross shaft, said first linkage movable between a third position and a fourth position;

a cam surface disposed between said cross shaft and said first linkage, said cam surface moving between a fifth position and a sixth position when said cross shaft rotates between said first position and said second position;

a first roller coupled to said first linkage adjacent said cam surface; and a second linkage coupled between said opening latch shaft and said first linkage, wherein said second linkage translates between a seventh position and an eighth position in response to said first linkage moving between said third position and said fourth position;

wherein said contact structure moves from said closed position to said open position in response to said second linkage translating between said seventh position and said eighth position.

7. The circuit breaker of claim 6 further comprising a second roller coupled to said first linkage adjacent said second linkage.

8. The circuit breaker of claim 7 wherein said first linkage includes a pivot, said pivot positioned to bias said first roller into contact with said cam surface.

9. The circuit breaker of claim 8 further comprising at least two standoffs coupled to said base, wherein said first linkage is disposed between said at least two standoffs.

10. The circuit breaker of claim 8 further comprising a third linkage coupled between said cross shaft and said first roller, said third linkage disposed to translate between a ninth position and tenth position when said cross shaft rotates between said first position and said second position, said cam surface being disposed on said third linkage.

11. The circuit breaker of claim 10 further comprising a fourth linkage coupled between said third linkage and said fourth linkage.

12. A method of operating a circuit breaker, said method comprising:

rotating a cross shaft coupled to said circuit breaker;

moving a cam surface from a first position to a second position in response to rotation of said cross shaft;

rotating a first linkage from a third position to a fourth position with said cam surface;

engaging a first roller coupled to said first linkage with said cam surface when rotating said first linkage from said third position to said fourth position;

translating a second linkage from a fifth position to a sixth position with said first linkage; and, opening a set of contacts with said second linkage when said first linkage is in said fourth position;

wherein said cross shaft rotates in response to a movement of said circuit breaker between and installed and a withdrawn position.

13. The method of claim 12 further comprising engaging a second roller coupled to said first linkage with said second linkage when said first linkage from said third position to said fourth position.

14. The method of claim 13 further comprising biasing said first roller into contact with said cam surface.

15. The method of claim 12 further comprising translating a third linkage from a seventh position to an eighth position in response to said rotation of said cross shaft, wherein said cam surface is arranged on said third linkage.

16. The method of claim 15 further comprising providing a first roller coupled to said first linkage and biasing said first roller towards said cam surface.

17. The method of claim 16 further comprising providing a second roller coupled to said first linkage and engaging said second linkage with said second roller in response to said translating of said third linkage.

* * * * *

UNITED STATES PATENT AND TRADEMARK OFFICE

CERTIFICATE OF CORRECTION

PATENT NO. : 8,525,054 B2
APPLICATION NO. : 12/971668
DATED : September 3, 2013
INVENTOR(S) : Pai et al.

It is certified that error appears in the above-identified patent and that said Letters Patent is hereby corrected as shown below:

On the Title Page, in item (75), under "Inventors", in Column 1, Line 1, delete "Karnataka State" and insert -- Secunderabad --, therefor.

On the Title Page, in item (75), under "Inventors", in Column 1, Line 2, delete "Beed" and insert -- Secunderabad --, therefor.

On the Title Page, in item (56), under "OTHER PUBLICATIONS", in Column 2, Line 4, delete "Merlin" and insert -- Class 0613 DC; Merlin --, therefor.

In the Specification

In Column 4, Line 38, delete "installation." and insert -- installation, --, therefor.

Signed and Sealed this
Twenty-eighth Day of January, 2014

Michelle K. Lee

Michelle K. Lee
*Deputy Director of the United States Patent and Trademark Office*